US005518874A

United States Patent [19]

Ito et al.

[11] Patent Number: 5,518,874

[45] Date of Patent: May 21, 1996

[54] METHOD OF MANUFACTURING A SILVER HALIDE EMULSION

[75] Inventors: Yoshiro Ito; Hirofumi Ohtani; Syoji Matsuzaka, all of Hino, Japan

[73] Assignee: Konica Corporation, Japan

[21] Appl. No.: 714,691

[22] Filed: Jun. 13, 1991

[30] Foreign Application Priority Data

Jun. 18, 1990 [JP] Japan ..... 2-159359

[51] Int. Cl.[6] ..... G03C 1/06

[52] U.S. Cl. ..... 430/569; 430/611

[58] Field of Search ..... 430/569, 567, 430/611, 612, 613, 614

[56] References Cited

U.S. PATENT DOCUMENTS

| | | | |
|---|---|---|---|
| 4,917,996 | 4/1990 | Matsuzaka et al. | 430/567 |
| 5,081,009 | 1/1992 | Tanemura et al. | 430/569 |

FOREIGN PATENT DOCUMENTS

| | | | |
|---|---|---|---|
| 0256781 | 2/1988 | European Pat. Off. | 430/569 |
| 278666 | 8/1988 | European Pat. Off. . | |
| 0337370 | 10/1989 | European Pat. Off. | 430/567 |

OTHER PUBLICATIONS

Patent Abstracts of Japan, vol. 13, No. 172 (P–862)(3520), Apr. 1989 (Abstract of JPA–1–6942, Jan. 1989).

*Primary Examiner*—Charles L. Bowers, Jr.
*Assistant Examiner*—John A. McPherson
*Attorney, Agent, or Firm*—Jordan B. Bierman; Bierman and Muserlian

[57] ABSTRACT

A method for manufacturing a silver halide emulsion comprising core/shell type silver iodobromide grains, said emulsion having an average iodide content of 3 mol % or more, each of the grains having two or more phases different in silver iodide content from each other which comprises an inner phase having silver iodide content of 10 mol % or more and an outermost phase having a silver iodide content lower than the iodide content of the inner phase, wherein a compound represented by the following formula [I] is present at least in a process prior to a desalting process:

formula [I]

wherein Z represents a group of atoms necessary to form a five- or six-membered heterocycle, which may be a condensed ring; and M represents an alkali metal atom or ammonium group.

8 Claims, No Drawings

METHOD OF MANUFACTURING A SILVER HALIDE EMULSION

BACKGROUND OF THE INVENTION

The present invention relates to a method of manufacturing silver halide emulsion, particularly to a method of manufacturing a silver halide emulsion low in fog, excellent in graininess, low in aging fog, and excellent in aging stability.

In the area of silver halide photographic light-sensitive materials, various approaches are being made in pursuit of a much higher speed. As one of such approaches, there is proposed to use core/shell type silver halide grains different in chemical components or physical properties between the inner portion and the other portion, generally, silver halide grains different in silver halide composition (hereinafter referred to as a core/shell type emulsion). In using such core/shell type emulsions for the purpose of enhancing the sensitivity, it is proposed to make up the light-sensitive layer into a multilayered structure in which the upper layer (a layer on the light-irradiated side) is a high speed layer.

In general, core/shell type emulsion grains have a structure in which the inner silver halide composition of the grains differs from the silver halide composition of the other portion of the grains; and, present inventors have found the fact that a core/shell type emulsion comprising grains of this structure having a high iodide content phase (a portion in which the iodide content is higher than that in the other portion) gives a fog high than that comprising grains having no high iodide content phase. Such an increased fog causes a large deterioration in graininess and a substantial desensitization with respect to a sensitivity-fog ratio.

Particularly, use of a core/shell type emulsion in a multilayered light-sensitive material involves risks to increase fog or aging fog and impair the shelf-life.

SUMMARY OF THE INVENTION

An object of the present invention is to solve the above problems and to provide a method of manufacturing a silver halide grain emulsion of high speed core/shell type having a substantially low fog, a high graininess, and an excellent storage stability.

The object of the invention attained by a method of manufacturing a silver halide emulsion comprising core/shell type silver iodobromide grains having an overall silver iodide content of 3 mol % or more, an inner portion containing silver iodide of 10 mol % or more inside the grain, and a surface silver iodide content lower than the iodide content of the inner portion, wherein a compound represented by the Formula [I] described later is present at least in a process before a desalting process.

DETAILED DESCRIPTION OF THE INVENTION

The invention will be hereunder described in detail. In the description below, a silver halide emulsion manufactured according to the invention will be occasionally referred to as a silver halide emulsion of the invention.

First, general steps to prepare an emulsion, which can be used to manufacture a silver halide emulsion of the invention, will be described.

As methods of preparing a silver halide emulsion, there have been known the neutral method, acid method and ammonia method.

A method which uses an ammoniacal silver nitrate solution is called the ammonia method. A silver halide emulsion of the invention may also be prepared by the ammonia method. In this method, a silver halide emulsion is prepared under a high pH condition.

In preparing an emulsion of the invention by this method, the pH of an ammoniacal silver halide used is preferably 10.4 or less, more preferably 9.0 or less.

Further, the pH during preparation of the silver halide emulsion is preferably 1 or more, and less than 8, preferably more than 2 and less than 7.5, and more preferably more than 5 and less than 7.5. The neutral method and acid method use a silver nitrate solution instead of an ammoniacal silver nitrate solution.

In the neutral method, the pH in the course of silver halide emulsion preparation is preferably more than 5 and less than 8; a preferable pH range for the acid method is more than 1 and less than 5.

During silver halide emulsion preparation (when seed grains are used, preparation time thereof is also included), there may be added, other than gelatin, a substance having adsorbency to silver halide grains. As such adsorbing substances, compounds used as sensitizing dyes, antifogging agents or stabilizers or heavy metal ions in photography are useful. Examples of the adsorbing substance can be seen in the specification of Japanese Patent O.P.I. Publication No. 7040/1987.

In order to reduce fogging in a silver halide emulsion and to improve pot life thereof, it is preferable that at least one of the antifogging agents or stabilizers among such adsorbing substances should be added during preparation of an emulsion.

The method of manufacturing a silver halide emulsion of the invention is to have the compound represented by General Formula [I] present at least in a process before a desalting process. And the compound represented by General Formula [I] (hereinafter occasionally referred to as the compound of the invention) is capable of functioning as antifogging agent or stabilizer.

Next, the compound represented by General Formula [I] will be described in detail.

GENERAL FORMULA [I]

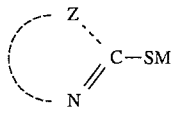

wherein Z represents a group of atoms necessary to form a five- or six-membered heterocycle composed of carbon atom, nitrogen atom and oxygen, sulfur or selenium atom, and said heterocycle may be a condensed ring; and M represents an alkali metal atom or an ammonium group.

Examples of the heterocycle formed by the above Z include pyridine, pyrimidine, imidazole, benzimidazole, naphthoimidazole, oxazole, benzoxazole, naphthoxazole, thiazolinethiazole, benzothiazole, naphthothiazole, selenazole, benzoselenazole, naphthoselenazole, triazole, oxadiazole, thiadiazole, triazine, tetrazole, purine and azaindene.

These heterocycles may have a substituent such as aromatic group, aliphatic group, hydroxy group, alkoxy group, aryloxy group, amino group, nitro group, halogen atom, carboxyl group, carbamoyl group or salt thereof, sulfo group or salt thereof, mercapto group, alkylmercapto group, acylamino group, sulfamoyl group, sulfamino group or carbamoyl group.

Among the compounds represented by General Formula [I], particularly preferred compounds in the invention are those represented by the following Formula [II], [III] or [IV].

FORMULA [II]

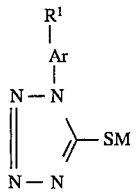

wherein Ar represents a phenylene, naphthylene or cyclohexylene group; $R^1$ is a hydrogen atom or a group capable of being substituted by a group represented by Ar; and M represents a hydrogen or alkali metal atom, or an ammonium group.

FORMULA [III]

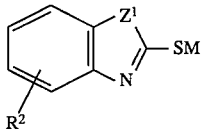

wherein $Z^1$ represents a sulfur, oxygen or selenium atom, or

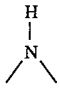

group; $R^2$ represents a hydrogen atom or a group capable of being a substituent; and M is the same as the above.

FORMULA [IV]

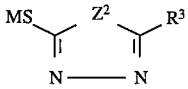

wherein $Z^2$ represents a sulfur, oxygen or selenium atom, or

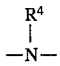

group; $R^4$ represents a hydrogen atom, or an alkyl, alkenyl, cycloalkyl, aryl, aralkyl, —$COR^5$, —$SO_2R^5$, —$NHCOR^5$ or —$NHSO_2R^6$ group; $R^5$ represents an alkyl, aryl, cycloalkyl, aralkyl or —$NH_2$ group; $R^6$ represents an alkyl, aryl, cycloalkyl or aralkyl group; and $R^3$ represents a hydrogen atom, or an alkyl, aryl, cycloalkyl, aralkyl, alkenyl, amino or heterocyclic group.

Typical examples of the compound represented by Formula [II] are S-1 to S-28 shown in the following table. In the table, these compounds are exemplified by specifying —$ArR^1$ and M.

| Exemplified | —$ArR^1$ | M |
|---|---|---|
| S-1 | 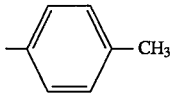 | H |
| S-2 | 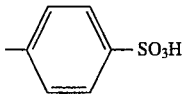 | H |
| S-3 | 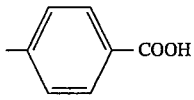 | H |
| S-4 | 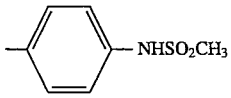 | H |
| S-5 | 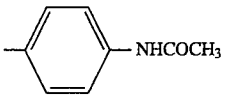 | H |
| S-6 | 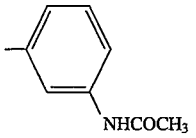 | H |
| S-7 | 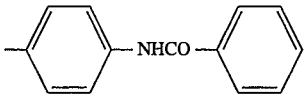 | Na |
| S-8 | 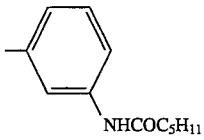 | K |
| S-9 | 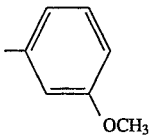 | K |
| S-10 | 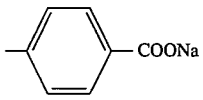 | Na |
| S-11 | 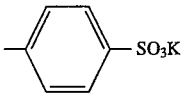 | K |
| S-12 | 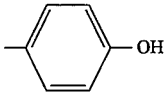 | H |
| S-13 | 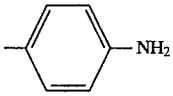 | H |

-continued
| Exemplified | $-ArR^1$ | M |
|---|---|---|
| S-14 | 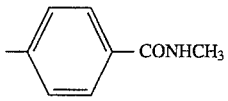 | H |
| S-15 | 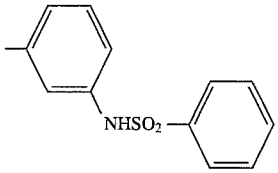 | H |
| S-16 | 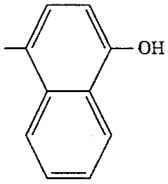 | H |
| S-17 | 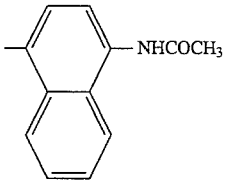 | H |
| S-18 | 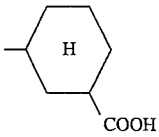 | H |
| S-19 | 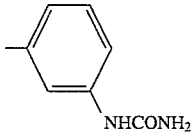 | H |
| S-20 | 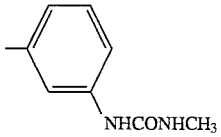 | H |
| S-21 | 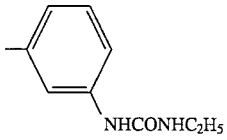 | H |
| S-22 | 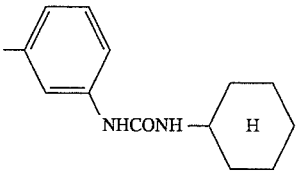 | H |
| S-23 | 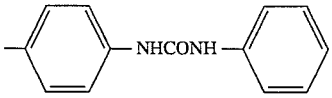 | H |
-continued
| Exemplified | $-ArR^1$ | M |
|---|---|---|
| S-24 | 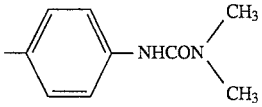 | H |
| S-25 | 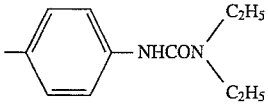 | H |
| S-26 | 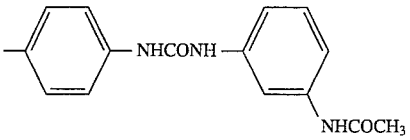 | H |
| S-27 | 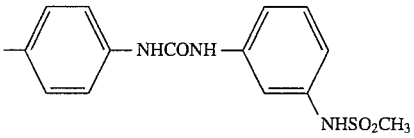 | H |
| S-28 | 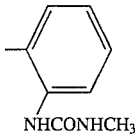 | H |
Typical examples of the compound represented by Formula [III] are the following S-29 to S-42.
S-29
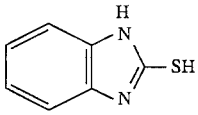
S-30
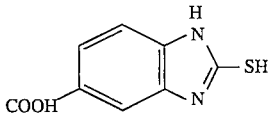
S-31
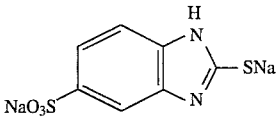
S-32
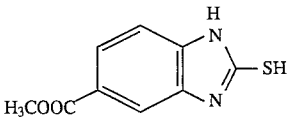
S-33
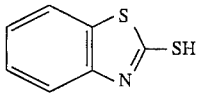
S-34
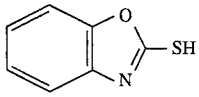
S-35
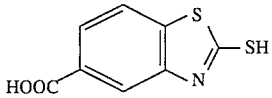

-continued

S-36

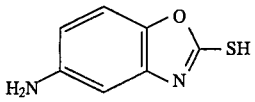

S-37

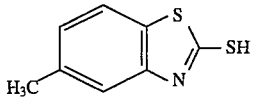

S-38

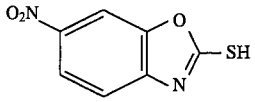

S-39

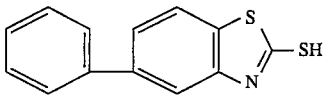

S-40

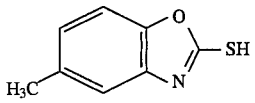

S-41

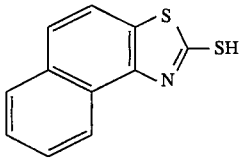

S-42

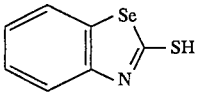

Typical examples of the compound represented by Formula [IV] are the following S-43 to S-54.

S-43

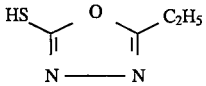

S-44

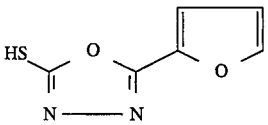

S-45

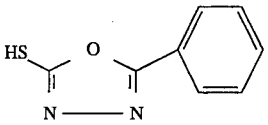

S-46

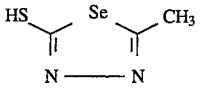

S-47

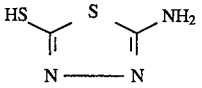

S-48

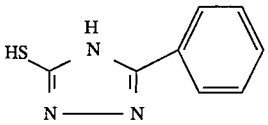

-continued

S-49

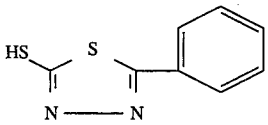

S-50

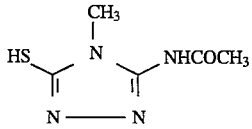

S-51

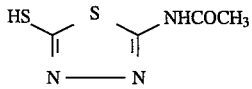

S-52

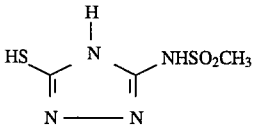

S-53

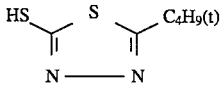

S-54

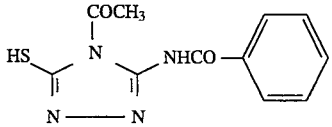

The above compounds represented by General Formula [I] can be synthesized according to methods described, for example, in the specifications of U.S. Pat. No. 3,266,897 and British Patent No. 1,275,701; R. G. Dubenko, V. D. Panchenko "Khim. Getevotsiki Soedin, sb-1: Azots. odev. Zhaschie Geterotsiky" pp. 199–201, (1967); K. Hotmann "The Chemistry of Heterocyclic Compounds, Imidazole and Its Derivatives" Part I, p. 384, published by Interscience (1953).

Incorporation of the compound of the invention into a silver halide emulsion can be carried out by steps of dissolving the compound in water or in an organic solvent miscible with water at any ratio (e.g., methanol, ethanol) and then adding the solution to an emulsion. The compound of the invention may be used singly or in combination with another compound selected from those represented by General Formula [I] or with a compound other than that represented by General Formula [I] (e.g., stabilizer or antifogging agent).

Addition of the compound of the invention to an emulsion must be made in a process before the desalting process, but it can be done in any process as long as it precedes the desalting process. For example, the compound may be added at any time before or during formation of silver halide grains, or in a period between completion of silver halide grain formation and start of the desalting process. But the addition in a period between start of silver halide grain formation and completion thereof is preferred.

The addition may be made at one time, or by dividing the total amount into several portions.

The addition amount of the above heterocyclic mercapto compounds is not particularly limited, but it is preferably $1\times10^{-6}$ to $1\times10^{-1}$ mol, and more preferably $1\times10^{-5}$ to $8\times10^{-3}$ mol per mol of silver halide. This amount is appropriately selected in consideration of the average grain size of silver halide grains and the type of the above compound.

For the silver halide emulsion of the invention which comprises silver halide grains having two or more phases different in silver iodide contents from each other, it is preferable that the high iodine content phase in the grains should be grown in the presence of the compound of the invention, and it is more preferable that more than 5% by volume of the high iodine content phase should be grown under conditions containing an inhibitor.

The silver halide emulsion of the invention is a core/shell type emulsion containing silver halide grains having a core/shell structure in which composition of the inner portion differs from that of the peripheral portion.

Among such core/shell type emulsions, the particularly preferred are silver iodobromide emulsions having a core/shell structure whose core contains more than 15 mol % and less than 40 mol % of silver iodide.

The invention has a large effect particularly on such core/shell type emulsions, since the deterioration in graininess attributable to storing becomes larger as the inner iodine content becomes higher.

Among the core/shell type emulsions, preferred ones include a silver halide emulsion consisting of grains having a clear core/shell structure, an emulsion consisting of double-structure grains described in Japanese Patent O.P.I. Publication No. 148442/1986, and an emulsion consisting of multi-structure grains described in Japanese Patent O.P.I. Publication No. 245151/1986.

Whether or not a silver halide emulsion has "a clear core/shell structure" described above can be determined by the following X-ray diffraction method.

The application of the X-ray diffraction method to silver halide grains can be seen, for example, in H. Hirsch's report in "Journal of Photographic Science", Vol. 10 (1962), pp. 129 and below. This is to utilize the phenomenon that when lattice constants are fixed according to a halide composition, a diffraction peak appears at an angle of diffraction which meets Bragg condition ($2d \sin \theta = n\lambda$).

In a standard measuring method based on this technology, a (420) face diffraction pattern of a silver halide is measured by the powder X-ray diffraction method, using Cu as target and Ks-ray of Cu as radiation source, at a tube voltage of 40 KV and a tube current of 100 mA. In such a measuring method, "a clear core/shell structure" is shown by the fact that the diffraction curve substantially has two diffraction peaks.

With regard to the iodide content of an emulsion having a clear core/shell structure which gives two diffraction peaks substantially, it is preferable that the emulsion should consist of grains having such structure that a small minimum appear between a diffraction peak corresponding to the low iodide content region and a diffraction peak corresponding to the inner high iodide content region, and that the magnitude of the diffraction peak corresponding to the high iodide content region should be 1/10 to 3/1 of the magnitude of the diffraction peak corresponding to the low iodide content region. A more preferable diffraction magnitude ratio is 1/5 to 3/1, and the most preferable ratio is 1/3 to 3/1.

The composition of the silver halide grains of the invention may be any of silver halides as long as they contain iodide, but silver iodobromide and silver chloroiodobromide are particularly preferred.

The silver halide grains of the invention have a silver iodide content of 10 mol % or more at the inner portion (e.g., core in a core/shell type grain), but this inner iodide content is preferably 10 to 40 mol %, and more preferably 10 to 35 mol %. The silver iodide content at the surface portion (e.g., shell in a core/shell type grain) is lower than that at the inner portion and preferably less than 6 mol %, more preferably 0 to 4 mol %. The volume of a shell of a core/shell type grain accounts for preferably 10 to 80%, more preferably 15 to 70%, and most preferably 20 to 50% of the total grain volume.

Further, there are preferably used those emulsions which possess between the core and the shell an intermediate layer having an intermediate silver iodide content between the core and the shell.

When core/shell type silver halide grains having such an intermediate layer are used, the volume of the intermediate layer is preferably 5 to 60%, more preferably 10 to 55% of the total grain volume.

It is preferable that the difference in silver iodide content between the shell and the intermediate layer should be 2 mol % or more, and that the difference in silver iodide content between the intermediate layer and the core should be 3 mol % or more. Further, the difference in silver iodide content between the shell and the core is preferably 5 mol % or more.

In preparing core/shell type grains, core/shell type silver halide grains can be grown from seed grains as described in Japanese Patent O.P.I. Publication No. 138538/1985. In this case, the grains may have at the center a region whose silver halide composition is different from that of the core. In such a case, the silver halide composition of the seed grains may be any of compositions such as silver bromide, silver iodobromide, silver chloroiodobromide, silver chlorobromide and silver chloride, but preferred ones are silver iodobromide having a silver iodide content of 10 mol % or more and silver bromide.

In the above case, the percentage of the seed grains in the total silver halide grains is preferably 50% or less, and more preferably 10% or less.

The emulsion of the invention may be prepared by various conventional methods such as the single-jet method, double-jet method and controlled double-jet method. But, in order to prepare a monodispersed core/shell type emulsion effectively, the controlled double-jet method is the most suitable.

Supply of iodide may be carried out, as is generally made in the above methods, by a method in which iodide is supplied in the form of ions using an aqueous solution of alkali halide such as KI or NaI, or using a mixed aqueous solution of KBr or NaBr and KI or NaI; or by a method in which iodide is supplied in the form of AgI fine particles as described in European Patent No. 323,215. But the latter method is preferred for its high capability of forming uniform high iodide content cores in the core/shell structure.

The emulsion of the invention is preferably subjected to desalting according to a conventional method, when it is made up into an emulsion with the prescribed grain conditions fully satisfied. Desalting can be carried out, for example, with a flocculating gelatin used in desalting of silver halide grains for seed grains; by the noodle washing method which uses gelation of gelatin; using the coagulation method which utilizes an inorganic salt consisting of a polyvalent anion such as sodium sulfate, anionic surfactant or anionic polymer such as polystyrene sulfonate; or by the flocculation method using a gelatin derivative such as acylated gelatin or carbamoylated gelatin.

The silver halide emulsion desalted as above is then redispersed in gelatin solution to give a silver halide emulsion.

The silver halide grains of the invention may be any of crystal forms such as regular crystals including cube, tetradecahedron and octahedron; twin crystals; or mixtures thereof. Among these crystal forms, regular crystals are preferred in view of their high capability of forming a monodispersed core/shell structure.

It is preferable that the average grain size of the silver halide grains of the invention should be 0.1 μm to 3.0 μm. Since aging deterioration in graininess becomes larger with the increase in grain size, the effect of the invention is much higher for larger grains. A more preferable average grain size is 0.3 μm to 2.0 μm, and the most preferable is 0.5 μm to 1.6 μm. The average grain size mentioned here is shown by the following expression, provided that the size of a cubic silver halide grain is defined as the length of its edge and that of a non-cubic grain is defined as the edge length of a cube converted in the same volume from an actual shape:

$$\text{Average grain size } r = \frac{r_i}{n}$$

where $r_i$ is a size of each grain, and n is the total number of measured grains.

In the process of preparing the above emulsion, temperature of a mother liquor is maintained preferably 10° to 70° C., more preferably 20° to 60° C.; pAg is maintained preferably 6 to 11, more preferably 7.5 to 10.5.

Further, it is preferable that the silver halide emulsion of the invention should be monodispersed.

Monodispersed silver halide grains means that when observed with an electron microscope, most of the grains are nearly the same in both shape and size.

For such monodispersed silver halide grains, the value (coefficient of variation) obtained by dividing the standard deviation of grain size distribution by the average grain size is preferably 0.20 or less.

EXAMPLES

The present invention is hereunder described with the following examples. As a matter of course, however, these examples by no means limit the scope of the invention. Prior to entering into particulars, there are described instances of preparing emulsions used in the examples.

Preparation of silver iodide fine grain emulsion AI-1

There were added in a reaction vessel an aqueous solution containing 5 wt % of ossein gelatin, and then 1 mol each of 3.5-N silver nitrate aqueous solution and 3.5-N potassium iodide aqueous solution were added thereto at a constant speed over a period of 30 minutes, under stirring at 40° C.

During the addition, pAg was maintained at 13.5 by conventional controlling means.

The silver iodide formed was a mixture of β-AgI and γ-AgI and had an average grain size of 0.06 μm.

This emulsion is hereunder referred to as emulsion AI-1.

Preparation of emulsion EM-1

Emulsion EM-1 was prepared using the following four solutions.

| Aqueous solution (a-1) | |
|---|---|
| Gelatin | 231.9 g |
| 10-vol % methanol solution of the following compound [I] | 30.0 ml |
| Aqueous ammonia (28%) | 1,056 ml |
| Water was added to make | 11,827 ml |

Compound [I]

$$HO(CH_2CH_2O)m(\overset{\overset{\displaystyle CH_3}{|}}{C}HCH_2O)_{17}(CH_2CH_2O)nH$$

(mean molecular weight ≒ 1,300)

| Aqueous solution (a-2) | |
|---|---|
| $AgNO_3$ | 1,587 g |
| Aqueous ammonia (28 %) | 1,295 ml |
| Water was added to make | 2,669 ml. |
| **Aqueous solution (a-3)** | |
| KBr | 1,572 g |
| Water was added to make | 3,774 ml. |
| **Silver-iodide-fine-grain-containing emulsion solution (a-4)** | |
| Emulsion containing silver iodide fine grains (AI-1) | 1,499.3 g |
| 4-Hydroxy-6-methyl-1,3,3a,7-tetrazaindene | 55.2 g |
| 510% potassium hydroxide aqueous solution | 14.75 ml |
| Water was added to make | 1,373 ml. |

While vigorously stirring aqueous solution (a-1) at 60° C., 0.407 molar equivalent of a seed emulsion (average grain size: 0.27 μm, average AgI content: 2 mol %) was added thereto. Then, pH and pAg were adjusted with acetic acid and a KBr aqueous solution.

Subsequently, aqueous solutions (a-2) and (a-3) and silver-iodide-fine-grain-containing emulsion solution (a-4) were added by the triple-jet method at flow rates respectively shown in Tables 2, while controlling pH and pAg as shown in Table 1.

After completion of the addition, an aqueous solution of phenylcarbamyl gelatin was poured therein and pH was adjusted to make grains flocculate, the grains were then washed for desalting.

After that, pH and pAg were adjusted to 5.8 and 8.06, respectively, at a temperature of 40° C.

The product was a monodispersed silver iodobromide emulsion having an average grain size of 0.99 μm, average silver iodide content of 8.0 mol % and a variation coefficient of grain size distribution of 11.2%. This emulsion is hereafter referred to as EM-1.

Table 3 shows EM-1's grain structure based on the recipe and volume percentages of respective phases.

TABLE 1

| | Grain growing conditions of EM-1 | | | | | | | | |
|---|---|---|---|---|---|---|---|---|---|
| Ag (%) | 0 | | 29 | | 29 | | 56 | | 100 |
| pH | 7.0 | → | 7.0 | ↓ | 6.0 | → | 6.0 | → | 6.0 |
| pAg | 7.8 | → | 7.8 | ↓ | 9.7 | → | 10.1 | → | 10.1 |

→: pH and pAg were kept constant.
→: continuously decreased.
↓: sharply decreased.

TABLE 2

| Addition pattern of (a-2 to 4) | | | | | |
|---|---|---|---|---|---|
| (a-2) | | (a-3) | | (a-4) | |
| Time (min) | Addition speed (ml/min) | Time (min) | Addition speed (ml/min) | Time (min) | Addition speed (ml/min) |
| 0 | 12.2 | 0 | 10.9 | 0 | 0 |
| 25.6 | 13.0 | 25.6 | 11.7 | 43.9 | 0 |
| 42.6 | 12.9 | 42.6 | 11.6 | 43.9 | 73.6 |
| 43.9 | 8.4 | 43.9 | 7.6 | 51.7 | 80.6 |
| 67.5 | 11.0 | 97.3 | 13.3 | 52.5 | 28.5 |
| 97.3 | 14.8 | 97.7 | 18.6 | 84.3 | 40.4 |
| 97.7 | 20.6 | 105.0 | 20.0 | 84.9 | 11.6 |
| 105.0 | 22.3 | 105.0 | 36.5 | 97.7 | 13.0 |
| 105.4 | 25.4 | 112.0 | 56.2 | 105.0 | 14.1 |
| 112.3 | 32.1 | 112.3 | 60.6 | 105.4 | 16.3 |
| 112.6 | 35.1 | 121.2 | 106.0 | 112.3 | 20.6 |
| 129.4 | 90.3 | 121.4 | 91.4 | 112.6 | 6.2 |
| 145.7 | 194.2 | 132.7 | 263.3 | 130.4 | 17.5 |
| 145.7 | 200.5 | 132.7 | 141.8 | 132.7 | 22.1 |
| 147.4 | 203.9 | 147.4 | 230.0 | 145.7 | 34.4 |

TABLE 3

| | 1st phase (seed) | 2nd phase | 3rd phase | 4th phase | 5th phase | 6th phase |
|---|---|---|---|---|---|---|
| Recipe-based silver iodide content (mol %) | 2 | 0 | 35 | 10 | 3 | 0 |
| Molar addition speed ratio of (a-4)/(a-2) (%) | 0 | 0 | 100* 35 10 | 10 | 3 | 0 |
| Volume percentate (%) | 3.8 | 9.2 | 15.8 1.8 9.2 4.8 | 6.7 | 58.7 | 5.8 |

*As the iodide content of silver iodobromide becomes high, excessive silver iodide fine grains are needed to obtain a desired composition. From the results obtained by X-ray diffraction, it is confirmed that in the preparing conditions of EM-1, a phase containing iodide as high as 35 mol % can be obtained by adding silver iodide fine grains in an excessive amount which makes the molar addition speed ratio to silver ions 100%, in the first stage of forming such a 35-mol %-silver-iodide-containing phase.

Preparation of Emulsion EM-2

There was prepared a monodispersed silver iodobromide emulsion having an average grain size of 0.99 μm, average silver iodide content of 4.1 mol % and grain size distribution of 11.2% (variation coefficient) in the same manner as with emulsion EM-1, except that the prescribed silver iodide content of the 3rd phase was changed from 35 mol % to 10 mol %. This emulsion is hereunder referred to as EM-2.

Preparation of Emulsion EM-3

There was prepared a monodispersed silver iodobromide emulsion having an average grain size of 0.99 μm, average silver iodide content of 8.0 mol % and grain size distribution of 11.2% (variation coefficient) in the same manner as with emulsion EM-1, except that 2 g of 4-hydroxy-6-methyl-1, 3,3a,7-tetrazaindene (hereunder referred to as TAI) was additionally added to silver-halide-fine-grain-containing emulsion solution (a-4). This emulsion is hereunder referred to as EM-3.

Preparation of emulsion EM-4

There was prepared a monodispersed silver iodobromide emulsion having an average grain size of 0.99 μm, average silver iodide content of 4.1 mol % and grain size distribution of 11.2% (variation coefficient) in the same manner as with emulsion EM-3, except that the prescribed silver iodide content of the 3rd phase of emulsion EM-3 was changed from 35 mol % to 10 mol %. This emulsion is hereunder referred to as EM-4.

Preparation of Emulsion EM-5

There was prepared a monodispersed silver iodobromide emulsion having an average grain size of 0.99 μm, average silver iodide content of 8.0 mol % and grain size distribution of 11.2% (variation coefficient) in the same manner as with emulsion EM-1, except that 100 ml of a 3:97 methanol-ethanol mixture containing 0.3 g of the above exemplified compound S-9 was added to emulsion solution (a-4). This emulsion is hereunder referred to as EM-5.

Preparation of Emulsion EM-6

There was prepared a monodispersed silver iodobromide emulsion having an average grain size of 0.99 μm, average silver iodide content of 4.1 mol % and grain size distribution of 11.2% (variation coefficient) in the same manner as with emulsion EM-5, except that the prescribed silver iodide content of the 3rd phase of emulsion EM-5 was changed from 35 mol% to 10 mol %. This emulsion is hereunder referred to as EM-6.

Preparation of Emulsion EM-7

There was prepared a monodispersed silver iodobromide emulsion having an average grain size of 0.99 μm, average silver iodide content of 8.0 mol % and grain size distribution of 11.2% (variation coefficient) in the same manner as with emulsion EM-1, except that 100 ml of a 3:97 methanol-ethanol mixture containing 0.3 g of the above exemplified compound S-8 was added to emulsion solution (a-4). This emulsion is hereunder referred to as EM-7.

Preparation of Emulsion EM-8

There was prepared a monodispersed silver iodobromide emulsion having an average grain size of 0.99 μm, average silver iodide content of 4.1 mol % and grain size distribution of 11.2% (variation coefficient) in the same manner as with emulsion EM-7, except that the prescribed silver iodide content of the 3rd phase of emulsion EM-7 was changed from 35 mol % to 10 mol %. This emulsion is hereunder referred to as EM-8.

Next, the examples which use the above emulsions are described.

EXAMPLE 1

To each of emulsions EM-1 to EM-8 prepared as above were added general photographic additives including spreading agent, thickener and hardener, and the following magenta coupler (M-1) as well. Each emulsion was then coated on a triacetyl cellulose film support so as to give a silver weight of 7 mg/100 $cm^2$ and dried. Samples 101 to 108 were thus prepared.

Each sample was divided into two portions, namely, sample A and sample B, and sample A was subjected to the following processing steps (a).

(M-1)

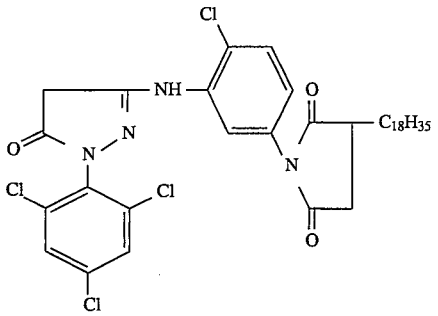

Processing (a) (at 38° C.)

| | |
|---|---|
| Color developing | 5 min 30 sec |
| Bleaching | 4 min 30 sec |
| Washing | 3 min |
| Fixing | 4 min |
| Washing | 3 min |
| Stabilizing | 2 min |
| Drying | |

Compositions of processing solutions used in the above processes were as follows.

| | |
|---|---|
| [Color developer] | |
| 4-Amino-3-methyl-N-ethyl-N-β-hydroxyethylaniline sulfate | 4.75 g |
| Anhydrous sodium sulfite | 4.25 g |
| Hydroxylamine ½ sulfate | 2.0 g |

-continued

| | |
|---|---|
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water was added to make 1 liter, and then pH was adjusted to 10.1. | |
| [Bleacher] | |
| Ammonium ferric ethylenediamine tetracetate | 100.0 g |
| Diammonium ethylenediamine tetracetate | 10.0 g |
| Ammonium bromide | 150.0 g |
| Glacial acetic acid | 10.0 ml |
| Water was added to make 1 liter, and pH was adjusted to 6.0 with aqueous ammonia. | |
| [Fixer] | |
| Ammonium thiosulfate | 175.0 g |
| Anhydrous ammonium sulfite | 8.5 g |
| Sodium metasulfite | 2.3 g |
| Water was added to make 1 liter, and pH was adjusted to 6.0 with acetic acid. | |
| [Stabilizer] | |
| Formalin (37% aqueous solution) | 1.5 ml |
| Konidax (product of Konica Corp.) | 7.5 ml |
| Water was added to make 1 liter. | |

The processed samples were photographed with an optical microscope, and the number of colored specks was counted for each photograph to take it as the number of fogged grains in the non-sensitized emulsion. Further, sample B was fogged by light and then processed with the same color developer as the above, after stopping with 3% acetic acid, the sample was washed.

Subsequently, sample B was photographed using an optical microscope as is the case with sample A, and the number of silver halide grains was counted.

The results obtained are shown in Table 4.

TABLE 4

| Sample No. | Emulsion used | Silver iodide content of inner high iodide phase (mol %) | Compound added | Number of colored specks in sample A | Number of silver halide grains in sample B | Fogged grain ratio of non-sensitized emulsion | Remarks |
|---|---|---|---|---|---|---|---|
| 101 | EM-1 | 35 | TAI | 122 | 16310 | 1/134 | Comparison |
| 102 | EM-2 | 10 | TAI | 90 | 16310 | 1/181 | Comparison |
| 103 | EM-3 | 35 | TAI | 116 | 16310 | 1/141 | Comparison |
| 104 | EM-4 | 10 | TAI | 90 | 16310 | 1/181 | Comparison |
| 105 | EM-5 | 35 | S-9 | 19 | 16310 | 1/858 | Invention |
| 106 | EM-6 | 10 | S-9 | 16 | 16310 | 1/1019 | Invention |
| 107 | EM-7 | 35 | S-8 | 20 | 16310 | 1/816 | Invention |
| 108 | EM-8 | 10 | S-8 | 16 | 16310 | 1/1019 | Invention |

It is understood from Table 6 that the fogged grain ratio of non-sensitized emulsion is smaller in the emulsions of the invention than in the comparative emulsions. Similar effects were also obtained with compounds S-1 to S-54.

EXAMPLE 2

Each of emulsions EM-1 to EM-8 was subjected to gold sensitization and then spectrally sensitized to green-sensitivity by adding 100 mg/mol AgX of the following sensitizing dye (I) and 65 mg/mol AgX of sensitizing dye (II) (AgX means silver halide, the same is applied hereunder). Then, the emulsion was stabilized with the addition of TAI and 1-phenyl-5-mercaptotetrazole.

Further, there was added to each emulsion a dispersion prepared by dissolving $5\times10^{-3}$ mol/mol AgX of the following magenta coupler (M-1), $6.2\times10^{-3}$ mol/mol AgX of magenta coupler (M-2) and $4.0\times10^{-3}$ mol/mol AgX of colored magenta coupler (CM-1) in di-t-nonyl phthalate and then dispersing said solution in an aqueous solution of gelatin, and subsequently, general photographic additives such as spreading agent and hardener were added thereto. Each coating solution prepared as above was coated on a subbed film base according to a usual method and dried to obtain samples 201 to 208.

Sensitizing dye I

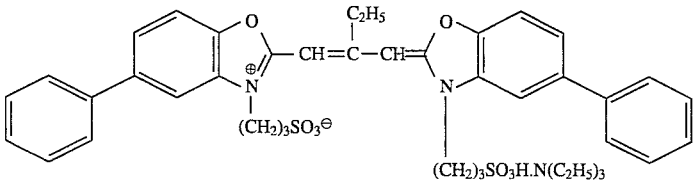

Sensitizing dye II

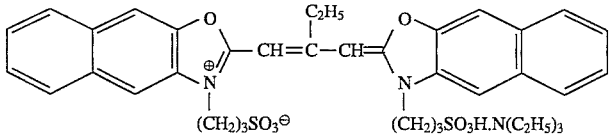

M-2

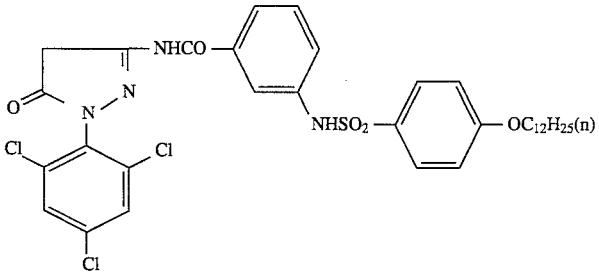

CM-1

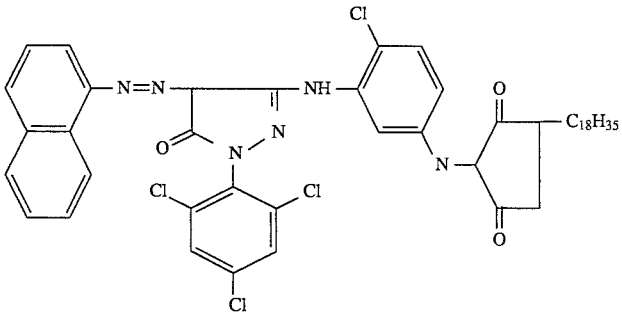

Each sample was exposed through an optical wedge according to a usual method and processed in the same manner as in the above, except that processing conditions were changed to the following processing steps (b). After that, sensitivity, fog and RMS graininess were measured (fresh test).

Further, samples stored for 2 days in an environment of 50° C., 80% RH were also exposed and developed in the same manner as in the above, and then evaluated for sensitivity and fog (incubation test).

| Processing (b) (at 38° C.) | |
|---|---|
| Color developing | 3 min 15 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |
| Drying | |

The results are shown in Table 5. In the table, the sensitivity is given by a reciprocal of the exposure necessary to give a minimum density (fog)+0.1 and expressed by a value relative to the sensitivity of sample 201 processed within the day, which is set at 100.

The RMS graininess is shown by a value 1,000 times the variation in density observed when the density of minimum density+1.2 is scanned with a microdensitometer having a circular scanning aperture of 25 μm.

TABLE 5

| Sample | | Fresh test | | Incubation test | | RMS | |
|---|---|---|---|---|---|---|---|
| No. | Emulsion | Fog | Sensitivity | Fog | Sensitivity | value | Remarks |
| 201 | EM-1 | 0.20 | 100 | 0.46 | 70 | 62 | Comparison |
| 202 | EM-2 | 0.15 | 79 | 0.36 | 43 | 47 | Comparison |
| 203 | EM-3 | 0.20 | 98 | 0.45 | 68 | 63 | Comparison |
| 204 | EM-4 | 0.15 | 77 | 0.35 | 40 | 47 | Comparison |
| 205 | EM-5 | 0.15 | 115 | 0.24 | 95 | 40 | Invention |
| 206 | EM-6 | 0.13 | 105 | 0.20 | 90 | 32 | Invention |
| 207 | EM-7 | 0.15 | 114 | 0.25 | 94 | 41 | Invention |
| 208 | EM-8 | 0.13 | 104 | 0.20 | 89 | 33 | Invention |

As apparent from Table 7, samples 205 to 208 using the emulsion of the invention are higher in sensitivity and better in graininess than comparative samples 201 to 204; moreover, these are less fogging under high temperature and high humidity conditions, slightly in sensitivity drop and excellent in shelf-life.

EXAMPLE 3

Layers having the following compositions were formed on a support in sequence to prepare multilayered color photographic material sample 301.

Sample 301 (for comparison)

| | | |
|---|---|---|
| 1st layer: | antihalation layer (HC-1) | |
| | a gelatin layer containing black colloidal silver | |
| 2nd layer: | intermediate layer (I. L.) | |
| | a gelatin layer containing a dispersion of 2,5-di-t-octylhydroquinone | |
| 3rd layer: | low-speed red-sensitive silver halide emulsion layer (RL-1) | |
| | core/shell emulsion (EM-9) comprised of AgBrI having an average grain size ($\bar{r}$) of 0.45 μm and AgI content of 7 mol % | |
| | coating weight of silver 1.8 g/m$^2$ | |
| | sensitizing dye I | $5.0 \times 10^{-4}$ mol/mol Ag |
| | sensitizing dye II | $0.7 \times 10^{-4}$ mol/mol Ag |
| | cyan coupler (C-1) | 0.10 mol/mol Ag |
| | colored cyan coupler (CC-1) | 0.002 mol/mol Ag |
| | DIR compound (D-1) | 0.0005 mol/mol Ag |
| | DSR compound (D-2) | 0.003 mol/mol Ag |
| | HBS-1A | 1.0 g/m$^2$ |
| 4th layer: | intermediate layer (I. L.) | |
| | the same gelatin layer as the 2nd layer | |
| 5th layer: | high-speed red-sensitive silver halide emulsion layer (RH-1) | |
| | EM-1 coating weight of silver 2.2 g/m$^2$ | |
| | sensitizing dye I | $2.1 \times 10^{-4}$ mol/mol Ag |
| | sensitizing dye II | $0.56 \times 10^{-4}$ mol/mol Ag |
| | cyan coupler (C-1) | 0.004 mol/mol Ag |
| | cyan coupler (C-2) | 0.014 mol/mol Ag |
| | colored cyan coupler (CC-1) | 0.001 mol/mol Ag |
| | DIR compound (D-2) | 0.0005 mol/mol Ag |
| | HBS-1A | 0.37 g/m$^2$ |
| 6th layer: | intermediate layer (I. L.) | |
| | the same as the 2nd layer, gelatin layer | |
| 7th layer: | low-speed green-sensitive silver halide emulsion layer (GL-1) | |
| | EM-9 coating weight of silver 1.0 g/m$^2$ | |
| | sensitizing dye III | $2.0 \times 10^{-4}$ mol/mol Ag |
| | sensitizing dye IV | $1.0 \times 10^{-4}$ mol/mol Ag |
| | magenta coupler (M-1) | 0.090 mol/mol Ag |
| | colored magenta coupler (CM-1) | 0.007 mol/mol Ag |
| | DIR compound (D-3) | 0.002 mol/mol Ag |
| | DIR compound (D-4) | 0.003 mol/mol Ag |
| | HBS-2A | 0.90 g/m$^2$ |
| 8th layer: | intermediate layer (I. L.) | |
| | the same gelatin layer as the 2nd layer | |
| 9th layer: | high-speed green-sensitive silver halide emulsion layer (GH-1) | |
| | EM-1 coating weight of silver 2.5 g/m$^2$ | |
| | sensitizing dye III | $1.2 \times 10^{-4}$ mol/mol Ag |
| | sensitizing dye IV | $0.8 \times 10^{-4}$ mol/mol Ag |
| | magenta coupler (M-1) | 0.01 mol/mol Ag |
| | colored magenta coupler (CM-1) | 0.005 mol/mol Ag |
| | DIR compound (D-3) | 0.0002 mol/mol Ag |
| | HBS-2A | 0.22 g/m$^2$ |
| 10th layer: | yellow filter layer (YC-l) | |
| | a gelatin layer containing dispersion of yellow colloidal silver and 2,5-di-t-octylhydroquinone | |
| 11th layer: | low-speed blue-sensitive silver halide emulsion layer (BL-1) | |
| | EM-9 coating weight of silver 0.5 g/m$^2$ | |
| | sensitizing dye V | $1.3 \times 10^{-4}$ mol/mol Ag |
| | yellow coupler (Y-1) | 0.35 mol/mol Ag |
| | HBS-2A | 0.25 g/m$^2$ |
| 12th layer: | high-speed blue-sensitive silver halide emulsion layer (HL-1) | |
| | EM-1 coating weight of silver 1.2 g/m$^2$ | |
| | sensitizing dye V | $1.8 \times 10^{-4}$ mol/mol Ag |
| | yellow coupler (Y-1) | 0.04 mol/mol Ag |
| | HBS-2A | 0.25 g/m$^2$ |
| 13th layer: | 1st protective layer (Pro-1) | |
| | a gelatin layer containing silver iodobromide (AgI content: 1 mol %, average grain size: 0.07 μm) at a silver weigh of 0.4 g/m$^2$ and ultraviolet absorbents UV-1 and UV-2 | |
| 14th layer: | 2nd protective layer (Pro-2) | |
| | a gelatin layer containing polymethacrylate particles (diameter: 1.5 μm) and formalin scavenger (HS-1) | |

Besides the above compounds, gelatin hardeners (H-1) and (H-2) and surfactants were added in each layer.

Sensitizing dye (I)
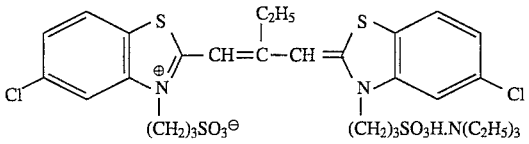
Sensitizing dye (II)
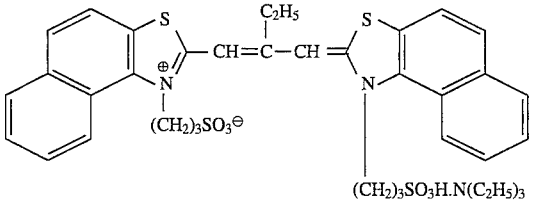
Sensitizing dye (V)
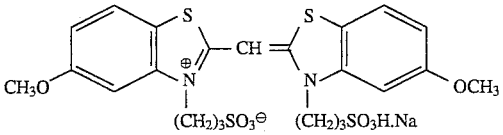
Sensitizing dye (III)
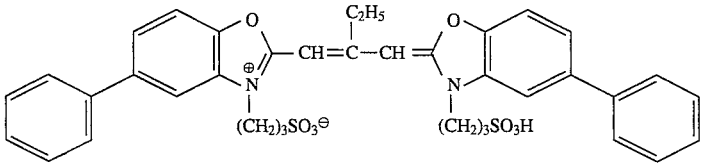
Sensitizing dye (IV)
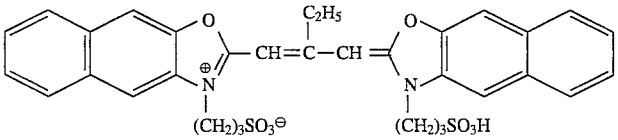
C-1
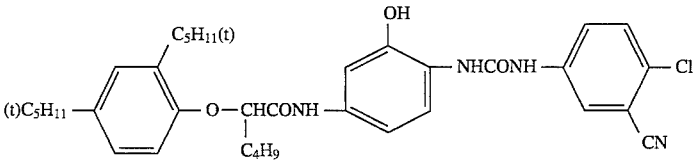
C-2
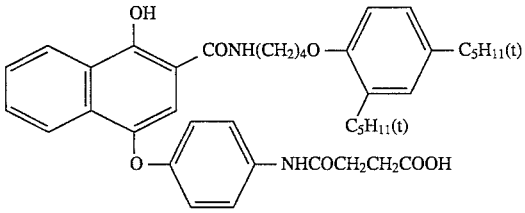

-continued
CC-1
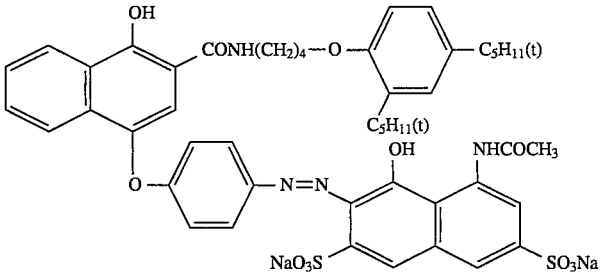
D-1
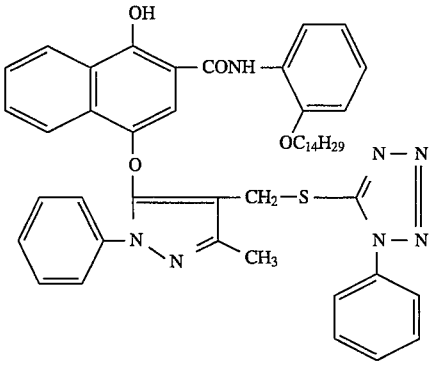
D-2
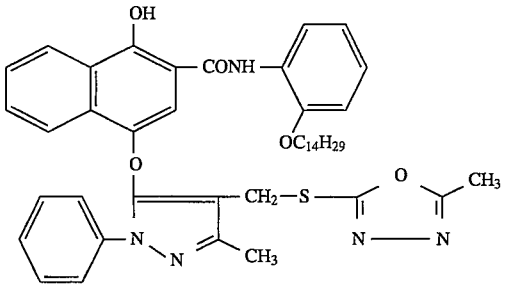
D-3
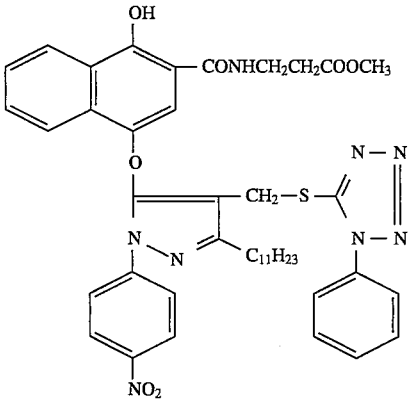

-continued
D-4
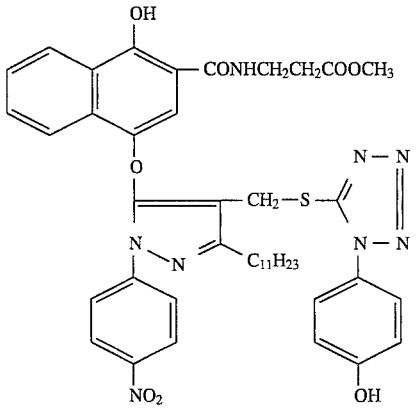
Y-1
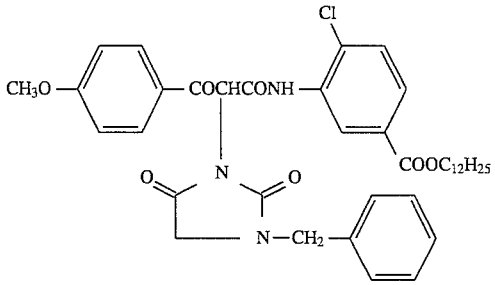
UV-1
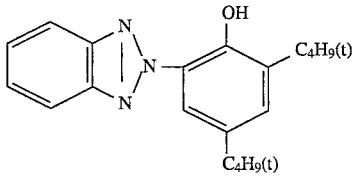
UV-2
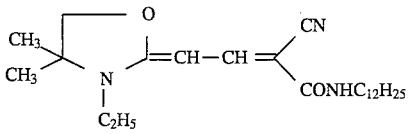
HS-1
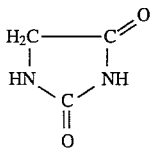
H-1
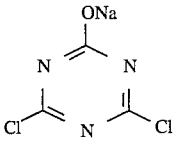
H-2
$[(CH_2{=}CHSO_2CH_2)_3CCH_2SO_2CH_2CH_2]_2NCH_2CH_2SO_3K$ -continued

HBS-1A

Dioctyl phthalate (DOP)

HBS-2A

Tricresyl phosphate (TCP)

Each of the above light-sensitive silver halide emulsions was prepared through optimum gold sensitization.

Next, samples 302 to 308 were prepared in the same manner as with sample 301, except that emulsion EM-1 used in RH-1 (5th layer), GH-1 (9th layer) and BH-1 (12th layer) was changed to emulsions EM-2 to EM-8 as shown in Table 6.

Each sample was subjected to wedge exposure, processing, and then evaluated for sensitivity, fog and RMS in the same manner as in Example 2. Further, samples preserved for 2 days in an environment of 50° C. and 80% RH were also exposed, developed and evaluated for sensitivity and fog as with the above.

The results are shown in Table 8.

In the table, the sensitivity means a reciprocal of the exposure necessary to give a density of minimum density (fog)+0.1 and expressed by a value relative to the sensitivity of sample 301 processed immediately which is set at 100.

TABLE 6

| Sample | | Fresh test | | Incubation test | | RMS | |
|---|---|---|---|---|---|---|---|
| No. | Emulsion | Fog | Sensitivity | Fog | Sensitivity | value | Remarks |
| 301 | EM-1 | 0.17 | 100 | 0.40 | 76 | 60 | Comparison |
| 302 | EM-2 | 0.14 | 80 | 0.30 | 46 | 45 | Comparison |
| 303 | EM-3 | 0.17 | 98 | 0.39 | 74 | 60 | Comparison |
| 304 | EM-4 | 0.14 | 78 | 0.29 | 44 | 44 | Comparison |
| 305 | EM-5 | 0.12 | 117 | 0.20 | 102 | 38 | Invention |
| 306 | EM-6 | 0.10 | 106 | 0.15 | 95 | 30 | Invention |
| 307 | EM-7 | 0.12 | 116 | 0.21 | 101 | 38 | Invention |
| 308 | EM-8 | 0.10 | 105 | 0.15 | 94 | 31 | Invention |

What is claimed is:

1. A method for manufacturing a silver halide emulsion comprising silver iodobromide grains, said emulsion having an average iodide content of 3 mol % or more, said grains having two or more phases, different in silver iodide content from each other, including an inner phase having an minimum silver iodide content of 10 mol %, and an outermost phase having a silver iodide content lower than the silver iodide content of said inner phase, wherein said inner phase of said grains is formed in the presence of a compound represented by the following formula [I]:

FORMULA [I]

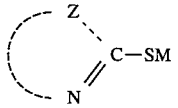

wherein Z represents a group of atoms necessary to form a five- or six-member heterocycle, which may be a condensed ring; and M represents hydrogen, alkali metal, or ammonium.

2. A method of claim 1, wherein said compound is represented by the following formula [II], [III] or [IV]:

FORMULA [II]

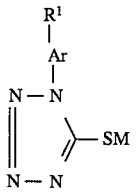

wherein Ar represents a phenylene, naphthylene or cyclohexylene group; $R^1$ is a hydrogen atom or a group capable of being a substituent for a group represented by Ar; and M represents a hydrogen or alkali metal atom, or ammonium group;

FORMULA [III[

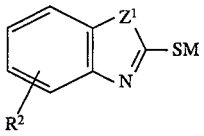

wherein $Z^1$ represents a sulfur, oxygen or selenium atom, or N—H group; $R^2$ represents a hydrogen atom or a group capable of being a substituent; and M is the same as the above;

FORMULA [IV]

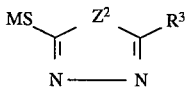

wherein $Z^2$ represents a sulfur, oxygen or selenium atom or N—$R^4$ group; $R^4$ represents a hydrogen atom, or an alkyl alkenyl, cycloalkyl, aryl, aralkyl, —$COR^5$, —$SO_2R^5$, —$NHCOR^5$, or —$NHSO_2R^6$ group; $R^5$ represents an alkyl, aryl, cycloalkyl, aralkyl or —$NH_2$ group; $R^6$ represents an alkyl, aryl, cycloalkyl or aralkyl group; $R^3$ represents a hydrogen atom, or an alkyl, aryl, cycloalkyl, aralkyl, alkenyl, amino or heterocyclic group.

3. A method of claim 1, wherein said compound is present before 95% by volume of said inner phase of the grains has been formed.

4. A method of claim 1, wherein said compound is present in an amount of from $1\times10^{-6}$ to $1\times10^{-1}$ mol per mol of silver halide.

5. A method of claim 1, wherein the silver iodide content of said inner phase is within a range of 10 to 35 mol %.

6. A method of claim 1, wherein the silver iodide content of said outermost phase is within a range of 0 to 4 mol %.

7. A method of claim 1, wherein said silver iodobromide grains are formed by a method in which fine silver iodide grains-containing emulsion is supplied as iodide source.

8. A method for manufacturing a silver halide emulsion comprising silver iodobromide grains, said emulsion having an average iodide content of 3 mol % or more, each of the grains having two or more phases different in silver iodide content from each other which comprises an inner phase having silver iodide content of from 10 to 35 mol % and an outermost phase having a silver iodide content of from 0 to 4 mol %, wherein said silver iodobromide grains are formed (i) by growing seed grains of silver bromide or silver iodobromide having a silver iodide content of not more than 10 mol %;

(ii) by supplying a fine silver iodide-containing emulsion as iodide source; and (iii) in the presence of a compound represented by the following formula [II] before 95% by volume of said inner phase of the grains has been formed:

FORMULA [II]

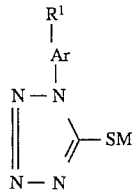

wherein Ar represents a phenylene, naphthylene or cyclohexylene group; $R^1$ is a hydrogen atom or a group capable of being a substituent for a group represented by Ar; and M represents a hydrogen or alkali metal atom, or ammonium group.

* * * * *